US009393171B2

(12) United States Patent
Ceoldo et al.

(10) Patent No.: US 9,393,171 B2
(45) Date of Patent: Jul. 19, 2016

(54) VIBRATING FOOTBOARD

(75) Inventors: Leonardo Ceoldo, Rome (IT); Fulvio Ceoldo, Rome (IT)

(73) Assignee: BOSCO SYSTEM LAB S.P.A., Rome (IT)

( * ) Notice: Subject to any disclaimer, the term of this patent is extended or adjusted under 35 U.S.C. 154(b) by 874 days.

(21) Appl. No.: 13/577,065

(22) PCT Filed: Feb. 7, 2011

(86) PCT No.: PCT/IT2011/000031

§ 371 (c)(1),
(2), (4) Date: Aug. 3, 2012

(87) PCT Pub. No.: WO2011/096008

PCT Pub. Date: Aug. 11, 2011

(65) Prior Publication Data

US 2012/0296244 A1 Nov. 22, 2012

(30) Foreign Application Priority Data

Feb. 5, 2010 (IT) ..... RM2010A0041

(51) Int. Cl.
*A61H 1/00* (2006.01)
*A61H 23/00* (2006.01)
(Continued)

(52) U.S. Cl.
CPC ..... *A61H 1/005* (2013.01); *A61H 1/00* (2013.01); *A61H 23/00* (2013.01); *A61H 23/02* (2013.01);
(Continued)

(58) Field of Classification Search
CPC ..... A61H 1/00; A61H 1/005; A61H 1/0237; A61H 1/0266; A61H 23/00; A61H 2023/002; A61H 23/004; A61H 23/006; A61H 2201/12; A61H 2201/1207; A61H 23/02; A61H 23/0254; A61H 23/0263; A61H 2023/0281; A61H 2201/5084; A61H 2230/60; A61H 2230/605; A61H 2205/12; A61H 2205/10; A61H 2205/106; A61H 2203/0406
See application file for complete search history.

(56) References Cited

U.S. PATENT DOCUMENTS 2,235,158 A * 3/1941 Krenzke ..... A61H 1/005 310/81
2,235,183 A * 3/1941 Wettlaufer ..... 601/65
(Continued)

FOREIGN PATENT DOCUMENTS

DE 10201255 A1 7/2003
EP 1649845 A1 4/2006
(Continued)

OTHER PUBLICATIONS

International Search Report of PCT/IT2011/000031 dated Apr. 28, 2011.
(Continued)

*Primary Examiner* — Justine Yu
*Assistant Examiner* — Tu Vo
(74) *Attorney, Agent, or Firm* — Hershkovitz & Associates, PLLC; Abe Hershkovitz; Stanislaus Aksman

(57) ABSTRACT

A vibrating footboard having a base plate and an intermediate plate coupled to each other, by first vibration-damping elements, at least one eccentric mass electric motor coupled to the intermediate plate, and two groups of upper plates capable to support feet of a user coupled to the intermediate plate through second vibration-damping elements. The vibrating footboard allows the user to undergo a neuromuscular stimulation, for both therapy and athletic enhancement.

14 Claims, 6 Drawing Sheets

(51) Int. Cl.
*A61H 23/02* (2006.01)
*A61H 1/02* (2006.01)

(52) U.S. Cl.
CPC ..... *A61H 23/0254* (2013.01); *A61H 23/0263* (2013.01); *A61H 1/0266* (2013.01); *A61H 2023/0281* (2013.01); *A61H 2201/0165* (2013.01); *A61H 2201/1207* (2013.01); *A61H 2201/1215* (2013.01); *A61H 2201/165* (2013.01); *A61H 2201/5084* (2013.01); *A61H 2203/0406* (2013.01); *A61H 2230/08* (2013.01); *A61H 2230/085* (2013.01); *A61H 2230/60* (2013.01); *A61H 2230/605* (2013.01); *A61H 2230/62* (2013.01)

(56) References Cited

U.S. PATENT DOCUMENTS 2,566,484 A * 9/1951 Coury ..... 601/65
2,845,063 A * 7/1958 Allen ..... 601/26
2,898,907 A * 8/1959 Heide ..... A61H 1/005 601/61
2,935,064 A * 5/1960 Moxley ..... A61H 1/005 601/65
2,978,243 A * 4/1961 Gabrielson ..... 472/14
3,009,460 A * 11/1961 Leach ..... 601/49
3,540,436 A * 11/1970 Hueftle, Jr. ..... 601/35
5,046,485 A * 9/1991 Slater ..... 601/65
5,271,416 A * 12/1993 Lepley ..... 600/595
5,273,028 A * 12/1993 McLeod et al. ..... 601/35
5,716,331 A * 2/1998 Chang ..... 601/50
6,319,213 B1 * 11/2001 Tomac ..... 601/53
7,402,145 B1 * 7/2008 Woggon et al. ..... 601/49
2004/0067833 A1 4/2004 Talish et al.
2005/0131319 A1 * 6/2005 der Meer ..... 601/49
2006/0155221 A1 * 7/2006 Kim ..... 601/29
2006/0253053 A1 * 11/2006 Koonar ..... 601/49
2007/0239088 A1 * 10/2007 Wu ..... 601/49
2008/0179976 A1 * 7/2008 Wu ..... 310/80

FOREIGN PATENT DOCUMENTS

GB 535937 A 4/1941
WO 01/56650 A1 8/2001
WO 2006/070429 A1 7/2006
WO 2009/000487 A1 12/2008

OTHER PUBLICATIONS

Written Opinion of the International Searching Authority of PCT/IT2011/000031.

* cited by examiner

VIBRATING FOOTBOARD

CROSS-REFERENCE TO RELATED APPLICATIONS

The present Application is a U.S. National Phase of PCT/IT2011/000031, filed on Feb. 7, 2011 ("PCT Application"), which claims priority from Italian Application No. RM2010A000041, filed on Feb. 5, 2010. The PCT and Italian Applications are hereby incorporated by reference in their entirety into the present Application. The PCT application, incorporated by reference herein, includes any amendments entered in the PCT application.

The present invention relates to a vibrating footboard provided with two plates for supporting feet of a user, that allows the user in a simple, efficacious, reliable, safe, comfortable, and inexpensive way, to undergo a neuromuscular stimulation, for both therapy and athletic enhancement.

It is known that when a muscle is stimulated through application of mechanical vibrations, it contracts in a reflex way very similar to what occurs when the muscle is caused to work through voluntary contractions, e.g. during execution of physical exercises.

In particular, by modifying the mechanical vibration frequency, it is possible to selectively cause more or less rigid muscles to work.

Recently, many gym machines for mechanical muscle stimulation have been manufactured, which substantially comprise a footboard for the leg muscles, or a vibrator for the arm muscles.

In particular, the vibrating footboards, such as for instance those described in patent applications No. GB 535937 and No. US 2004/067833A1, comprise a base platform coupled through some vibration-damping elements to an upper plate to which a vibrating motor transmitting vibrations is attached.

Such vibrating footboards are useful for training, because they permit to obtain in a shorter time results similar to those of the usual physical exercises in a gym, for getting a good muscle tone with few minutes of application, and for physiotherapical uses aimed at maintenance of the muscle tone or at the functional recovery of the muscles, e.g. during or after periods of immobilisation due to fractures or surgery.

However, present vibrating footboards have some drawbacks.

First of all, rigidity of vibrations transmitted to the footboard renders the use of such vibrating footboards inadvisable to elderly subjects, or subjects suffering from osteoporosis, or who have had recent trauma (or surgery, in particular orthopaedic surgery).

Moreover, a further drawback rises from the fact that the lower limbs of any subject have a different rigidity, also called "stiffness", and, consequently, they tend to differently oppose to the same (in amplitude and oscillation) vibration that is applied to the plane supporting the same limbs. This entails that the assembly formed by the vibrating footboard, the vibration-damping elements and one of the two limbs will react in a different way to the vibrations generated by the motor depending on which of the two limbs is resting on the footboard. As a consequence, when both the limbs are resting on the same footboard, the latter will move according to accelerations which are not exactly the ones corresponding to each one of the two different limbs, whereby the neuromuscular stimulation has not the maximum possible efficacy and, in some extreme cases (in particular when the stiffness of the two limbs is very different, as it occurs for instance after a period of immobilisation of one of the two limbs), it may also be harmful.

Also, neuromuscular stimulation loses efficacy over time, due to adaptation of the limbs to the vibrating stresses to which they are subjected.

Finally, vibrations are transmitted to the limbs with a hardness rendering user's perception of the same vibrations unpleasant.

In this context, the solution proposed according to the present invention is introduced.

It is an object of this invention, therefore, to allow a user in a simple, efficacious, reliable, safe, comfortable, and inexpensive way, to undergo a neuromuscular stimulation through vibrations transmitted to the lower limbs, for both therapy and athletic enhancement.

It is specific subject-matter of the present invention a vibrating footboard comprising a base plate and at least one intermediate plate, the base plate being coupled to at least one intermediate plate through first elastic means capable to oppose to a movement of said at least one intermediate plate with respect to the base plate, vibrating means being coupled to said at least one intermediate plate, the vibrating footboard being characterised in that it further comprises one or more first upper plates, capable to support feet of a user, said one or more first upper plates being coupled to said at least one intermediate plate through second elastic means capable to oppose to a movement of said one or more first upper plates with respect to said at least one intermediate plate Always according to the invention, the number of said one or more first upper plates may be even, said two or more first upper plates being preferably subdivided into two groups specularly equal to each other with respect to a longitudinal axis of the vibrating footboard, the number of said first upper plates being more preferably equal to either two or six, when said number is equal to six said first upper plates being still more preferably subdivided into two groups of three specularly equal to each other with respect to the longitudinal axis of the footboard wherein the three first upper plates of each group correspond to a heel, a first metatarsus and a fifth metatarsus of a respective user's foot.

Still according to the invention, said one or more first upper plates may be provided with a pattern comprising the outline of user's feet.

Furthermore according to the invention, the vibrating footboard may comprise two or more intermediate plates at least partially superimposed on each other and preferably connected to each other through third elastic means capable to oppose to mutual movements of adjacent intermediate plates.

Always according to the invention, said first elastic means comprises or consists of one or more, preferably four, first vibration-damping elements, preferably comprising or consisting of first elastic components, more preferably made of material comprising natural or synthetic rubber, the number of said one or more first upper plates being still more preferably equal to two.

Still according to the invention, said second elastic means comprises or consists of one or more, preferably three, second vibration-damping elements for each one of said one or more first upper plates, said second vibration-damping elements preferably comprising or consisting of elastic components, more preferably made of material comprising natural or synthetic rubber, still more preferably the number of said one or more first upper plates being equal to two and said second vibration-damping elements being placed in correspondence with three areas of each one of the two first upper plates capable to receive a heel, a first metatarsus and a fifth metatarsus of a respective user's foot.

Furthermore according to the invention, the vibrating footboard may further comprise one or more sets of one or more further upper plates having size and/or shape different from the ones of said one or more first upper plates.

Always according to the invention, said vibrating means may comprise or consist of at least one eccentric mass electric motor, preferably coupled in correspondence with a barycentre of said at least one intermediate plate, more preferably to a lower surface of said at least one intermediate plate, said at least one motor having still more preferably a longitudinal axis transversely orientated with respect to a longitudinal axis of the vibrating footboard, said at least one motor being capable to generate preferably an undulating movement, having a frequency more preferably ranging from 1 to 1000 Hz, still more preferably from 5 to 500 Hz, even more preferably from 20 to 55 Hz, and having an amplitude more preferably ranging from 1 to 10 mm, still more preferably from 2 to 5 mm, said at least one motor being more preferably capable to generate both a clockwise and an anticlockwise undulating movement with respect to the longitudinal axis of said at least one motor.

Still according to the invention, said vibrating means may be capable to generate vibrations having different amplitude for each one of two or more corresponding areas of said one or more first upper plates, preferably the number of said one or more first upper plates being equal to two and said vibrating means being capable to generate vibrations having different amplitude for each one of said two first upper plates, more preferably said vibrating means comprising or consisting of at least one electric motor having eccentric masses which are unbalanced with respect to a transverse axis of said at least one electric motor.

Furthermore according to the invention, the vibrating footboard may further comprise a control panel connected to said vibrating means, preferably provided with a display and a keyboard, more preferably provided with at least one interface for reading and/or writing one or more portable memory media.

Always according to the invention, the vibrating footboard may further comprise a detection system comprising movement detecting means capable to detect a movement of said one or more first upper plates and/or a movement of said at least one intermediate plate, said movement detecting means preferably comprising at least one triaxial accelerometer incorporated into or integrally coupled to one of said one or more first upper plates or to said at least one intermediate plate, said movement detecting means being connected to a first processing device to which it sends detected data related to one or more movement parameters preferably selected from the group comprising movement amplitude, acceleration, and velocity, said first processing device preferably automatically controlling said vibrating means on the basis of said data detected by said movement detecting means, said first processing device being more preferably housed in a control panel.

Still according to the invention, the vibrating footboard may further comprise vibration detecting means preferably comprising at least one triaxial accelerometer incorporated into or coupled to at least one support applicable to and/or wearable by a user, said at least one support being preferably selected from the group comprising an elastic collar and an elastic band, said vibration detecting means being connected to a second processing device to which it sends detected data related to one or more movement parameters preferably selected from the group comprising vibration amplitude, frequency, acceleration, and velocity, said second processing device preferably automatically controlling said vibrating means on the basis of said data detected by said vibration detecting means, said second processing device being more preferably housed in a control panel.

Furthermore according to the invention, the vibrating footboard may further comprise a system for determining an optimal frequency of a vibration generated by said vibrating means and for automatically setting parameters of operation of said vibrating means, comprising a processing and controlling electronic device, preferably housed in a control panel of the vibrating footboard, capable to set said parameters of operation of said vibrating means, said processing and controlling electronic device being capable to be connected to one or more muscular electrical activity sensors, preferably electromyography sensors, applicable to one or more muscles of a user, one or more sensors being capable to send detection data to said processing and controlling electronic device, said processing and controlling electronic device processing the data received from said one or more sensors so as to determine, within a range included between a lower limit frequency, preferably equal to 1 Hz, more preferably variable, and an upper limit frequency, preferably equal to 1000 Hz, more preferably variable, an optimal frequency of the vibration generated by said vibrating means at which the electrical activity of said one or more muscles of the user is maximum, said processing and controlling electronic device setting a frequency of the vibration generated by said vibrating means so that it is equal to such optimal frequency.

Always according to the invention, the vibrating footboard may further comprise a system for detecting a position of the user's feet comprising one or more sensors, preferably coupled to said one or more first upper plates in correspondence with areas capable to receive a heel and/or a first metatarsus and/or a fifth metatarsus of the user's feet, said one or more sensors being connected to a third processing device, preferably housed in a control panel of the vibrating footboard, to which they send detected data, said third processing device preferably processing the received data for determining a correct arrangement of the user's feet on said one or more first upper plates, more preferably depending on the position of a user's barycentre, said third processing device still more preferably displaying information related to said position of the user's feet on a display of the control panel of the vibrating footboard and/or through light devices, said one or more sensors being preferably arranged in an array and controlled by said third processing device or said one or more sensors being movable and placeable on said one or more first upper plates and said third processing device displaying on a display of the control panel of the vibrating footboard a position of each one of said one or more movable sensors.

Still according to the invention, the vibrating footboard may be provided with a podoscope, preferably integrated into said one or more first upper plates, capable to detect a foot laying of the user, said podoscope more preferably sending detected data to a fourth processing device for displaying on a display of a control panel of the vibrating footboard the foot laying of the user.

The vibrating footboard according to the invention permits to be used in complete safety also by subjects very sensitive to mechanical vibrations, such as elderly subjects, and/or suffering from osteoporosis, and/or who have had recent trauma (or orthopaedic surgery). In particular, the vibrating footboard according to the invention may be used by subjects under rehabilitation and hence for physiotherapical use, where it is necessary a particularly calibrated use.

Furthermore, a preferred embodiment of the vibrating footboard according to the invention takes account of the different stiffness, in particular neuromuscular stiffness, of the user's lower limbs, that generates a different reaction of the neuromuscular system of each limb to the vibrations generated by the motor. In fact, thanks to the presence of two independent upper plates for the two user's feet, such preferred embodiment of the vibrating footboard according to the invention permits a different neurostimulation of the two limbs deriving from the different acceleration induced by the different stiffness between right and left limbs, allowing to obtain a high efficacy for both the limbs.

Also, such preferred embodiment of the vibrating footboard according to the invention permits to assess the different muscle stiffness of the user, monitoring the different acceleration to which each one of the two supporting upper plates is subjected.

Furthermore, thanks to the two supporting upper plates, the neuromuscular stimulation exerted by such preferred embodiment of the vibrating footboard according to the invention on each one of the two limbs is extremely efficacious.

Moreover, the possibility of reversing the rotation directions of the vibrating motor permits to create a different neuromuscular stimulation, avoiding that an adaptation of the neuromuscular structures of the limbs to the received stimulation creates and, consequently, maintaining over time efficacy of the same stimulation.

Finally, the vibrating footboard according to the invention transmits softer vibrations to the limbs, whereby perception of the same vibrations by a user is more pleasant with respect to traditional vibrating footboards. In particular, "softness" of vibrations permits to trace a path adapted to applications in clinical context with osteoporotic subjects.

Since the vibrating footboard according to the invention may be provided with an either automatic or manual control of the motor operation, through the flexible possibility of combination of amplitude, frequency, and acceleration over all the axes it is adapted to any subject, with very soft and pleasant vibrations for elderly and neophyte subjects, indispensable during the first steps of rehabilitation from accidents or after surgery, for elongation and decompression, and also with powerful vibrations for enhancing use of strength.

In this regard, the vibrating footboard according to the invention has numerous advantageously applications. By way of example, and not by way of limitation, it may be used in the context of strategies aimed at particular geriatric pathologies, such as in case of osteoporosis, and in all those plans, whether these are rehabilitation ones or not, directed to improvement of the quality of life, intended in terms of degree of articular, muscle and neuromuscular function of the geriatric subject under consideration. Also, the vibrating footboard according to the invention may be advantageously used in the field of sports training, most of all when the latter is aimed at increasing the levels of explosive strength, being as a matter of fact an optimal alternative and/or supplementary technique with respect to the classical strength training. Furthermore, the vibrating footboard according to the invention may be still advantageously used as an integral part of all programs wherein the maximum limb muscle extensibility is desired, as well as in work plans aimed at chronic painful pathologies which may benefit from an increase of the muscular-tendinous compliance.

The present invention will be now described by way of illustration, not by way of limitation, according to its preferred embodiments, by particularly referring to the Figures of the annexed drawings, in which:

FIG. 1 is a cross-section front view along line BB passing through the intermediate plate of FIG. 4;

FIG. 2 is a cross-section side view along line AA passing through the right upper plate of FIG. 5;

In the following description, the same reference numerals will be used to designate the same elements in the Figures.

Figure 2:
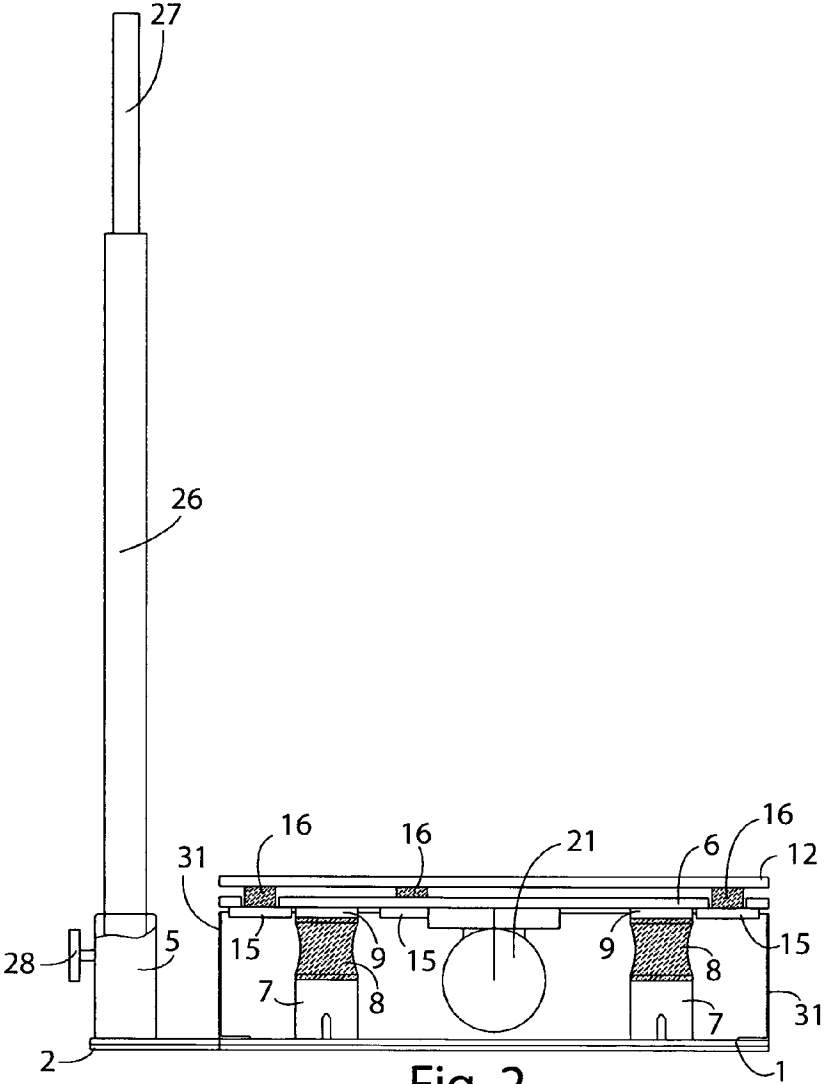
FIG. 2 shows a cross-section side view of the vibrating footboard of FIG. 1.

In the following description, reference will be made to some preferred embodiments of the vibrating footboard according to the invention having two or more upper plates and only one intermediate plate. However, it should be noted that the vibrating footboard according to the invention may comprise a sole upper plate and/or two or more intermediate plates, connected to the base plate and/or at least partially overlapped each other and preferably connected to each other through one or more vibration-damping elements or other elastic means capable to oppose to mutual movements of adjacent intermediate plates, still remaining within the scope of protection of the present invention as defined by the attached claims.

With reference to FIGS. 1-5, it may be observed that a preferred embodiment of the vibrating footboard according to the invention comprises a base plate 1 (preferably of metal), inferiorly provided with a anti-slip coating 2 (preferably of rubber) for preventing the base plate 1 from slipping on the supporting surface. In particular, the base plate 1 is shaped so as to have two projecting areas, right one 3 and left one 4, to each one of which a respective hollow seat 5 for housing tubular uprights 26, for supporting a handgrip or handlebar 27 allowing a user to hold him/herself during footboard operation, may be attached (e.g. through screws—not shown—, or other fastening means, inserting into corresponding holes 25 of the respective projecting area 3 or 4). Preferably, the tubular uprights 26 are lockable within the respective hollow seats 5 through fastening screws 28.

The vibrating footboard shown in FIGS. 1-5 further comprises an intermediate plate 6 (preferably of metal) coupled to the base plate 1 through four vibration-damping elements, preferably comprising rigid supports 7 (more preferably of metal) onto which elastic components 8 (more preferably made of material comprising natural or synthetic rubber, e.g. neoprene) having the free end provided with an end rigid slab 9 (preferably of metal) are attached. In particular, the four vibration-damping elements are coupled to the base plate 1 and to the intermediate plate 6 through screws (not shown), or other fastening means, inserting into corresponding holes 10 and 11 of the same plates 1 and 6, respectively.

The vibrating footboard still comprises a right upper plate 12 and a left upper plate 13. The two upper plates 12 and 13

(preferably of metal) are specularly equal with respect to a longitudinal axis 14 of the footboard; in particular, when a user steps on the vibrating footboard, he/she rests each one of the two feet on a respective upper plate 12 and 13 orientating it parallel to such longitudinal axis 14. Each one of the two upper plates 12 and 13 is coupled to the intermediate plate 6 through respective three vibration-damping elements, each one comprising a supporting rigid slab 15 (preferably of metal) onto which an elastic component 16 (preferably made of material comprising natural or synthetic rubber, e.g. neoprene) is attached. The supporting rigid slab 15 of each one of the vibration-damping elements (which couple each one of the two upper plates 12 and 13 to the intermediate plate 6) is integrally coupled to the lower surface of the intermediate plate 6 in correspondence with a respective hole of the latter; in particular, in FIG. 4 the three holes related to the coupling vibration-damping elements of the right upper plate 12 are indicated with reference numerals 17, whereas the three holes related to the coupling vibration-damping elements of the left upper plate 13 are indicated with reference numerals 18. Preferably, the rigid slabs 15 of each one of the vibration-damping elements may be integrally coupled to the lower surface of the intermediate plate 6 through screws 33, or other fastening means, inserting into corresponding holes 29 of the same plate 6. The elastic component 16 of each one of the vibration-damping elements coupling each one of the two upper plates 12 and 13 to the intermediate plate 6 is attached to the corresponding upper plate 12 or 13 through screws (not shown), or other fastening means, inserting into corresponding holes 19 and 20 of the same plates 12 and 13, respectively.

Preferably, the three vibration-damping elements coupling each one of the two upper plates 12 and 13 to the intermediate plate 6 are placed in correspondence with the areas onto which the respective user's foot rests and onto which the weight of the user's body is loaded, i.e. in correspondence with the areas of the upper plate onto which the heel, the first metatarsus and the fifth metatarsus of the user's foot rest; to this end, each one of the two upper plates could be provided with a pattern representing the outline of the respective foot for indicating the correct position of the feet to the user. Given the variability of size and shapes of the sole of the feet, such areas correspond to a statistical average of population of users to whom the use of the vibrating footboard is directed (e.g., adults, male adults, female adults, kids, etc.); in this regard, it is possible to replace the two upper plates 12 and 13 and the intermediate plate 6 so that they adapt each time to the population to which the user belong. Other embodiments of the vibrating footboard according to the invention may also have a number of the vibration-damping elements coupling each one of the two upper plates 12 and 13 to the intermediate plate 6 that is different from three, preferably larger than three, and also their position may be different from what shown in the Figures.

Figure 1:
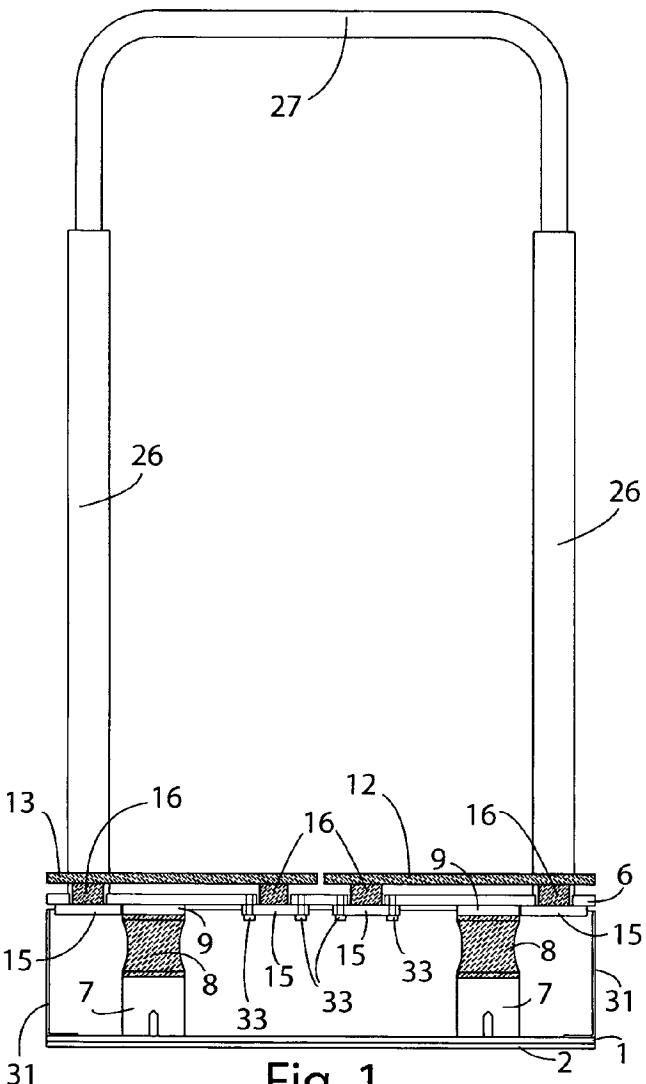
FIG. 1 shows a cross-section front view of a preferred embodiment of the vibrating footboard according to the invention.
Figure 3:
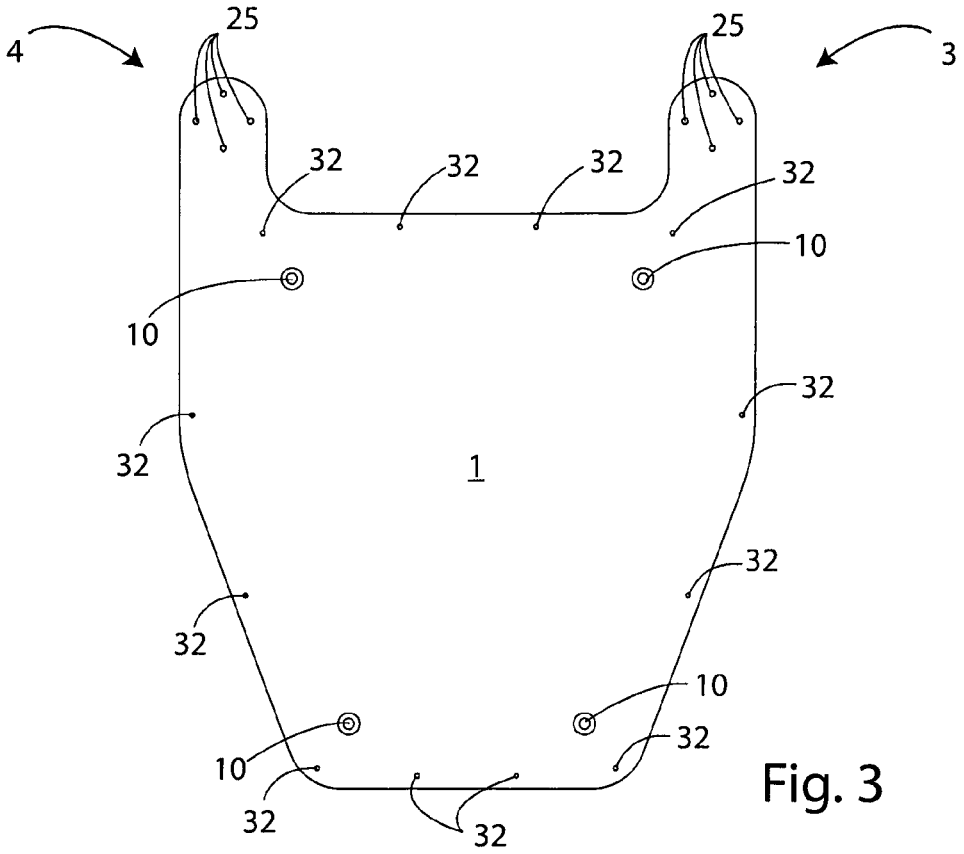
FIG. 3 shows a top plan view of the base plate of the vibrating footboard of FIG. 1.

Moreover, the vibrating footboard shown in FIGS. 1-5 comprises an eccentric mass electric motor 21, having substantially cylindrical shape, integrally coupled to the lower surface of the intermediate plate 6 in correspondence with the barycentre of the same intermediate plate, and transversely orientated with respect to the longitudinal axis 14 (and, hence, to the feet of a user who would step on the vibrating footboard), as shown in FIGS. 1 and 2. In particular, the motor 21 may be integrally coupled to the lower surface of the intermediate plate 6 through screws (not shown), or other fastening means, inserting into corresponding holes 30 of the same plate 6. The motor 21 generates an undulating movement at a frequency preferably ranging from 1 to 1000 Hz, more preferably from 5 to 500 Hz, still more preferably from 20 to 55 Hz, and of amplitude preferably ranging from 1 to 10 mm, more preferably from 2 to 5 mm. The motor 21 may rotate both clockwise and anticlockwise.

Also, the vibrating footboard of FIGS. 1-5 comprises a side wall 31 (that may be also subdivided into two or more separate portions) integrally coupled to the base plate 1, preferably through screws (not shown), or other fastening means, inserting into corresponding holes 32 of the same base plate 1. In particular, the side wall 31 is separated from the intermediate plate 6 by a distance sufficient to avoid any interference of the same side wall with the movement of the intermediate plate 6.

Finally, the vibrating footboard shown in FIGS. 1-5 preferably comprises a control panel (not shown), more preferably supported by the tubular uprights 26. The control panel is connected to the motor 21 and allows a user to set and control the operation of the same motor. The control panel is preferably provided with a display and a keyboard.

When the motor 21 is activated, generating an undulating movement that is transmitted to the intermediate plate 6, the vibration-damping elements coupled to the base plate 1 and to the intermediate plate 6 and those coupled to the intermediate plate 6 and to the two upper plates 12 and 13 (more precisely the related elastic components 8 and 16, respectively) oppose to such movement and introduce a side component in the undulating movement of the intermediate plate 6 and two upper plates 12 and 13, respectively. Therefore, the intermediate plate 6 and the two upper plates 12 and 13 move according to an undulating movement, in the direction of rotation of the motor 21, having vertical and anteroposterior vibrations, whereas the side components of such undulating movement are drastically reduced (most of all in the two upper plates 12 and 13 on which the user rests) with respect to the vibrating footboards of prior art. This entails that the undulating-vibrating movement of the two upper plates 12 and 13 is much "softer" with respect to that of the intermediate plate 6, thus eliminating any uneasiness that the user usually feels with the traditional vibrating footboards.

Figure 6:
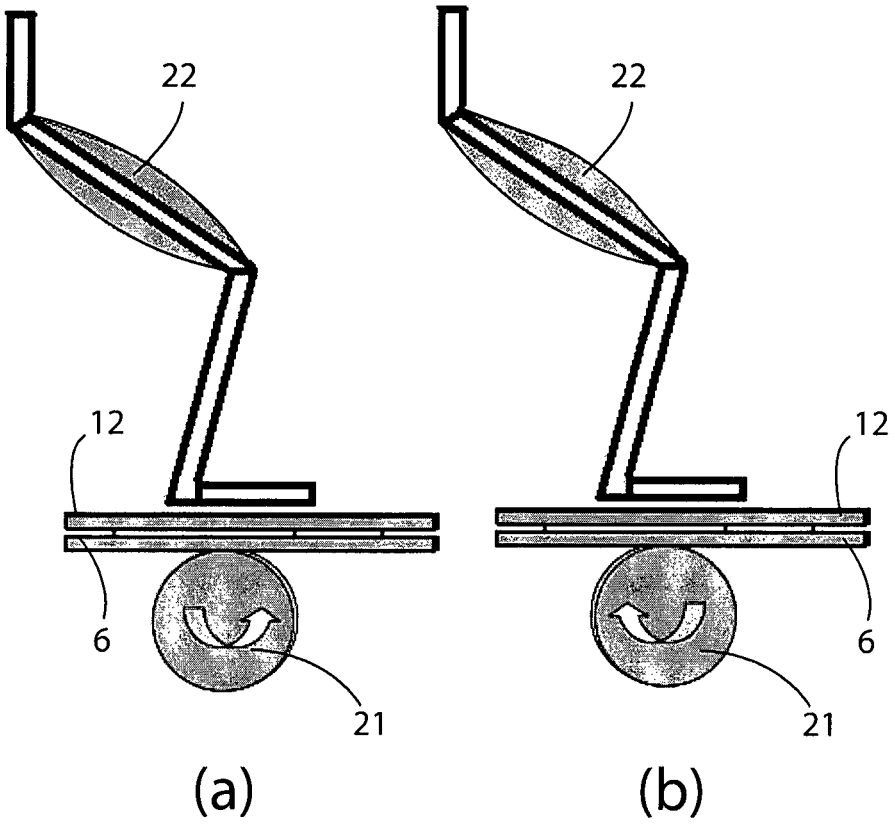
FIG. 6 shows a schematic representation of two operation conditions of the vibrating footboard of FIG. 1.

With reference to FIG. 6, it may be schematically observed the operation of the motor 21 in the two rotation directions when an user (of whom only the right leg 22 is represented) is on the vibrating footboard. In particular, when the motor 21 rotates anticlockwise with respect to the axis exiting the plane of FIG. 6 (operation schematised by the arrow on the motor 21 in FIG. 6*a*), it causes the intermediate plate 6 and the two upper plates, only the right one 12 of which is visible, to make a specific undulating-vibrating movement forward-upwards-backwards-downwards; instead, when the motor 21 rotates clockwise (see FIG. 6*b*), it causes the intermediate plate 6 and the two upper plates, only the right one 12 of which is visible, to make a different specific undulating-vibrating movement backwards-upwards-forward-downwards. Hence, the two different rotation directions permit to generate two different neuromuscular stimulations.

The user (or a supervising operator, such as, for instance, a physiotherapist) may set on the control panel of the vibrating footboard the rotation direction of the motor 21, as well as its frequency and amplitude.

In particular, the inventors have carried out experiments for detecting the accelerations produced by the vibrations using a triaxial accelerometer on each one of the two upper plates 12 and 13, comparing such detections with those obtained by a triaxial accelerometer placed on the sole upper plate of a conventional vibrating footboard. The obtained results show that the cusps of the acceleration curves along the three axes detected on the two upper plates of the vibrating footboard according to the invention are greatly smoothed with respect to those of the acceleration curves detected on the upper plate of the conventional vibrating footboard. This shows that, under equal vibration efficacy (also independently for the two user's limbs in the preferred embodiment shown in FIGS. 1-5), the one of the vibrating footboard according to the invention is more comfortable with respect to the one produced by a conventional vibrating footboard, eliminating user's feeling of annoyance or uneasiness normally caused by vibrating stimulation.

Other embodiments of the vibrating footboard according to the invention may have a number of upper plates, on which the user rests, different from two. By way of example and not by way of limitation, besides the embodiments having a sole upper plate, the upper plates may be in even number and subdivided into two groups, preferably specularly equal to each other with respect to a longitudinal axis of the footboard, each one of which groups corresponds to one of the two right and left upper plates 12 and 13 shown in FIGS. 1-5.

Figure 7:
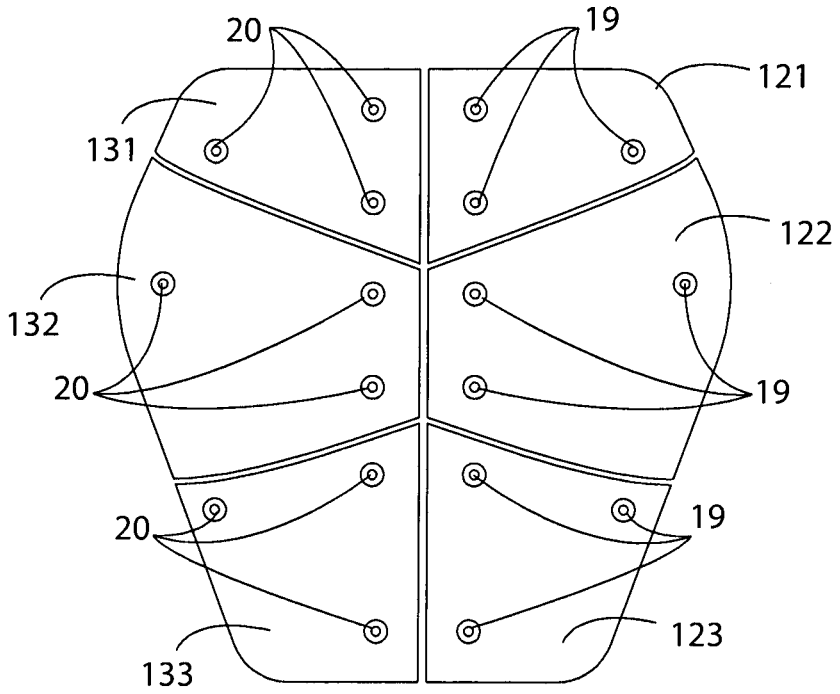
FIG. 7 shows a top plan view of the upper plates of a second embodiment of the vibrating footboard according to the invention.
Figure 5:
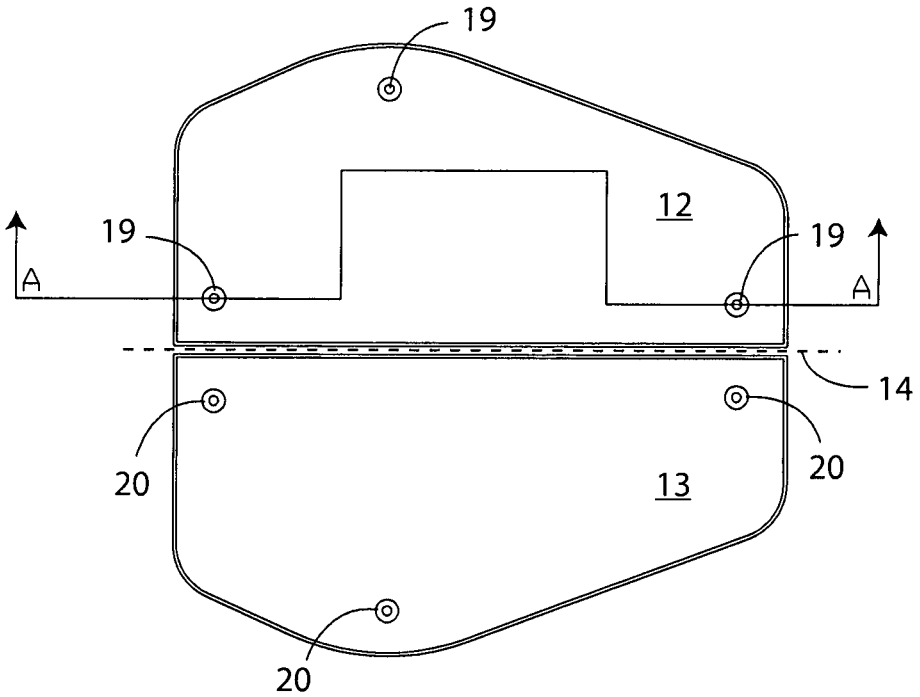
FIG. 5 shows a top plan view of the two upper plates of the vibrating footboard of FIG. 1; in particular.

By way of example, FIG. 7 shows six upper plates, subdivided into two groups specularly equal with respect to the longitudinal axis 14 of the footboard and each one of which comprises three upper plates corresponding to heel, first metatarsus and fifth metatarsus of the respective user's foot. In particular, FIG. 7 shows the right upper plate 121 of the first metatarsus, the right upper plate 122 of the fifth metatarsus, the right upper plate 123 of the heel, the left upper plate 131 of the first metatarsus, the left upper plate 132 of the fifth metatarsus, and the left upper plate 133 of the heel; similarly to the footboard shown in FIGS. 1-5, each one of the six upper plates is preferably coupled to an intermediate plate (not shown) through respective three vibration-damping elements (but the number of which could be any number larger than or equal to 1) similar to those shown in FIGS. 1 and 2, the elastic components of which are attached to the corresponding upper plate through screws (not shown), or other fastening means, inserting into corresponding holes 19 and 20 of the same upper plates 121, 122, 123, 131, 132 and 133.

Other embodiments of the vibrating footboard according to the invention may comprise more than one vibrating motor (or two or more other vibrating means), preferably two or more eccentric mass electric motor, each one having more preferably a longitudinal axis transversely orientated with respect to the longitudinal axis 14 of the vibrating footboard, the longitudinal axes of the two or more motors being still more preferably aligned along a same axis.

Figure 4:
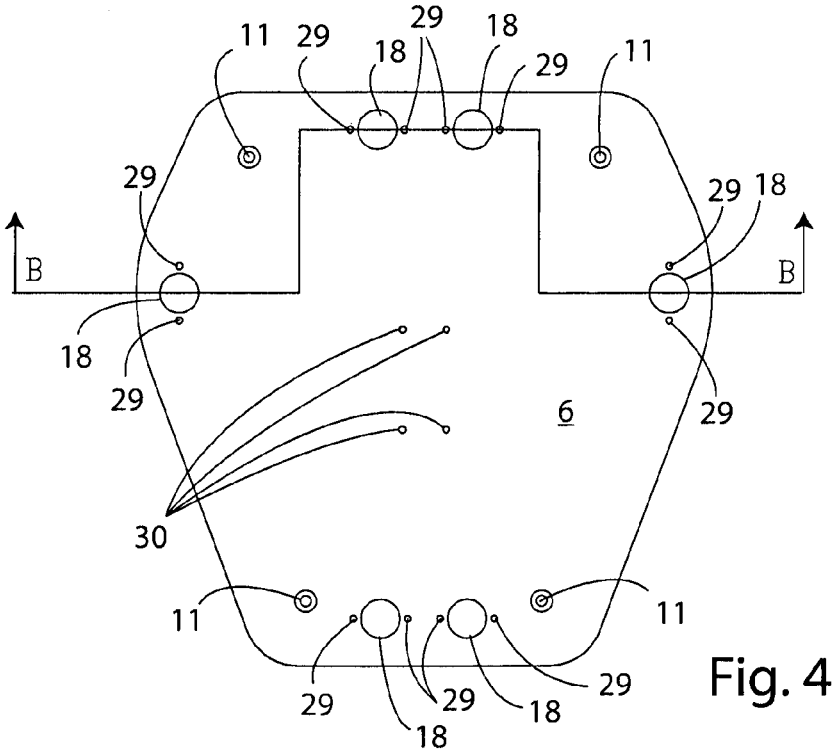
FIG. 4 shows a top plan view of the intermediate plate of the vibrating footboard of FIG. 1; in particular.
Figure 8:
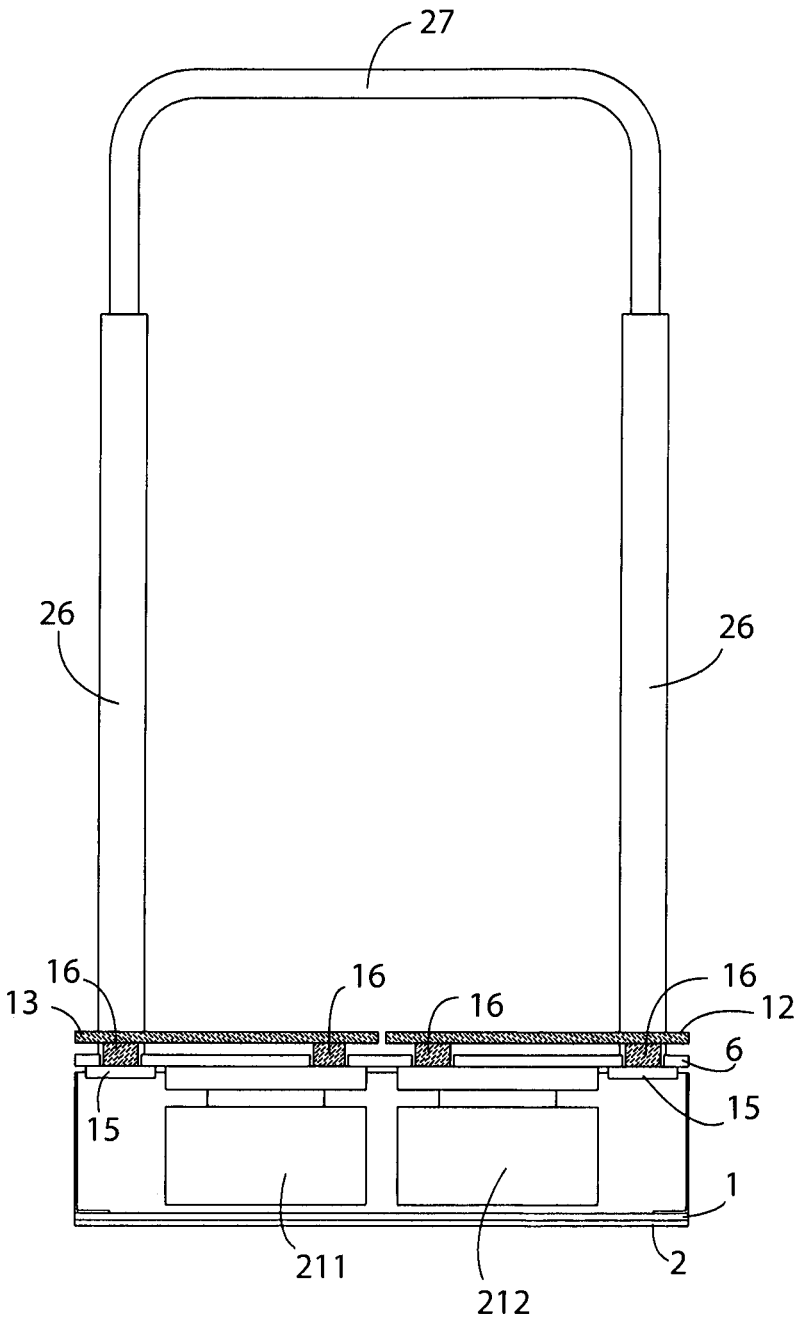
FIG. 8 shows a cross-section front view of a third embodiment of the vibrating footboard according to the invention.

By way of example, FIG. 8 shows a cross-section view of a vibrating footboard similar to the one shown in FIGS. 1-5, from which it differs for the presence of two aligned electric motors 211 and 212, instead of only one, integrally coupled to the lower surface of the intermediate plate 6 in correspondence with the barycentre of the same intermediate plate, and transversely orientated with respect to the longitudinal axis 14 (and, hence, to the feet of a user who would step on the vibrating footboard); in particular, the view of FIG. 8 is a cross-section front view along line BB passing through the intermediate plate of FIG. 4, wherein the two motors 211 and 212 are not shown in cross-section.

Other embodiments of the vibrating footboard according to the invention may comprise, (at least) one vibrating motor capable to generate vibrations having amplitude different for each one of two (or more) corresponding areas of the (one or more) upper plates. By way of example, in case of a footboard with two right and left upper plates similar to the one shown in FIGS. 1-5, such (at least one) vibrating motor may generate vibrations having amplitude different for each one of the two upper plates.

Figure 9:
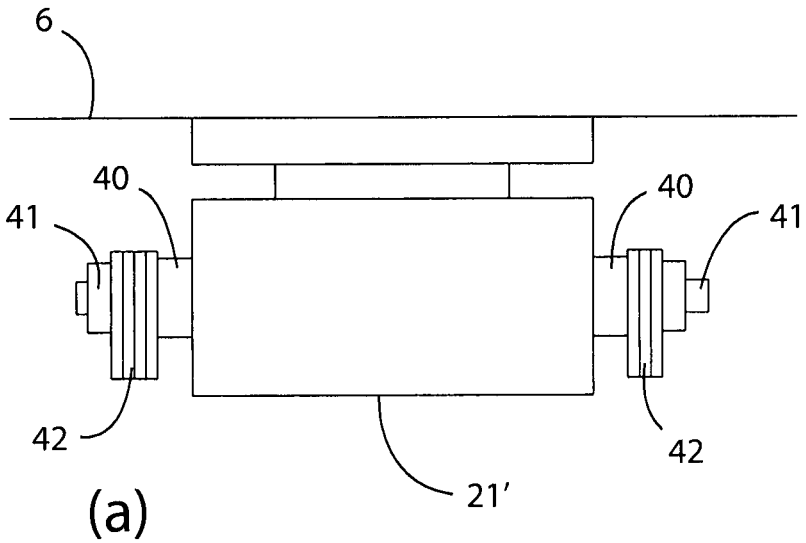
FIG. 9 shows a front view (FIG. 9*a*) and a right side view (FIG. 9*b*) of a vibrating motor of a fourth embodiment of the vibrating footboard according to the invention.
Figure 9:
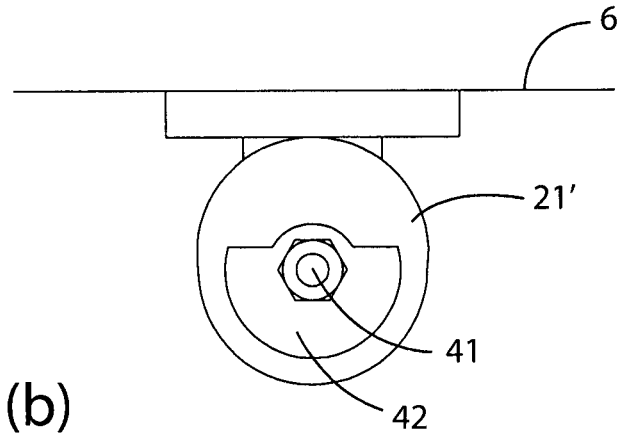

By way of example, FIG. 9 shows a front view (FIG. 9*a*) and a right side view (FIG. 9*b*) of an eccentric mass electric motor 21' integrally coupled to the lower surface of an intermediate plate 6 of an embodiment of the vibrating footboard according to the invention similar to the one shown in FIGS. 1-5, from which it differs only in that the eccentric masses of the motor 21' are unbalanced with respect to a transverse axis of the same motor. In fact, the motor 21' is provided with a driving shaft 40 at the ends of which eccentric plates 42 in number different to each other are coupled in a conventional way (e.g. through screws 41); in particular, the number of eccentric plates 42 coupled to the right end of the driving shaft 40 of the motor 21' is equal to three, whereas the number of eccentric plates 42 coupled to the left end of the driving shaft 40 of the motor 21' is equal to four. This entails that the vibrations generated on the left upper plate 13 have larger amplitude than those generates on the right upper plate 12.

Other embodiments of the vibrating footboard according to the invention may be provided with a detection system of the movement of each one of the upper plates on which the user rests. By way of example, with reference to an embodiment of the footboard shown in FIGS. 1-5 provided with such a detection system, this system may comprise at least one triaxial accelerometer (or another sensor) for each one of the two upper plates 12 and 13, preferably incorporated (e.g. housed in a hollow seat) or integrally coupled to the lower surface of the respective upper plate, so as to detect accelerations along the three Cartesian axes. Such triaxial accelerometers send the detected data, related to one or more movement parameters (such as, for instance, movement amplitude, acceleration and velocity), to a processing device, preferably housed in the control panel of the footboard, that processes them, e.g. for obtaining the relative amplitudes of the oscillations and indirectly defining the degree of contraction and relaxation of user's peripheral musculature. Such detection system, directly giving the data related to the movement of the upper plates 12 and 13, depending on the neuromuscular reaction of the user's limbs, allows a supervising operator to monitor and determine the best use of the vibrating footboard. By way of example, and not by way of limitation, in the case where the acceleration detected by the triaxial accelerometers is lower than a maximum threshold, then the use of the vibrating footboard is not harmful to the user, otherwise, i.e. in the case where the detected acceleration is equal to or larger than said maximum threshold, it is necessary to modify, possibly even automatically through the processing device, the frequency at which the vibrating motor operates because the high detected acceleration is an indication of the fact that the user does not absorb vibrations; said maximum threshold of acceleration is preferably a value depending on the amplitude and/or frequency at which the vibrating motor operates, and more preferably it is adjustable depending on the user's status, being higher for an athlete than for an elderly or traumatised subject.

Alternatively to or in combination with the sensors (preferably triaxial accelerometers) for detecting the movement parameters of each one of the upper plates, the just described detection system may comprise a third triaxial accelerometer (or another sensor), incorporated (e.g. housed in a hollow seat) or integrally coupled to the intermediate plate 6, that sends the detected data to a processing device. Such third triaxial accelerometer permits to detect the absolute values of one or more movement parameters (such as, for instance, movement amplitude, acceleration and velocity), because the movement of the intermediate plate 6 is exclusively affected by the user's mass, differently from the two upper plates 12 and 13 the movement of which is strongly affected by the user's capability of controlling vibrations (e.g. through limbs stiffness, muscle elasticity, etc.).

Alternatively to or in combination with the sensors (preferably triaxial accelerometers) for detecting the movement parameters of each one of the upper plates and/or of the intermediate plate 6, the just described detection system may comprise (at least) one fourth triaxial accelerometer (or another sensor), connected to the processing device through either wireless or wired connection, applicable, preferably through an elastic collar or an elastic band (into which it is preferably inserted), to the user, preferably at the neck base and/or around the waist and/or around a limb of the user. Such (at least one) fourth triaxial accelerometer is capable to detect one or more vibration parameters (such as, for instance, amplitude, frequency, acceleration and velocity) transmitted to the user, permitting a control of the vibrating motor 21 that is either automatic by the processing device or manual by an operator (e.g. a physiotherapist) for preventing the generated vibrations from reaching the user's soft tissues.

Other embodiments of the vibrating footboard according to the invention may be also provided with a system for determining the optimal frequency of vibration and for automatically setting the parameters of operation of the (at least one) vibrating motor. In fact, each organ, or body segment, can be described as a body having its own vibration resonance frequency, thus attenuating different vibrating frequencies. In this regard, the exposure of body segments and internal organs to resonance frequencies must be limited, since it may be harmful for some organs. This means that an optimal frequency of activation of the musculature corresponds to each person and to each muscle of the same person.

Preferably, the system for determining the optimal frequency of vibration and for automatically setting the parameters of operation of the (at least one) vibrating motor with which the vibrating footboard according to the invention may be provided is the one disclosed in International Patent No. WO 01/56650. In order to determine whether a muscle undergoing vibration is vibrating at its own optimal frequency of activation, such system may advantageously use one or more electromyography sensors of surface, applied on one of the extensor muscles of the legs, preferably on the vastus lateralis of the quadriceps muscle. Such system permits to test a plurality of muscular groups, through a plurality of electromyography channels, to compare them and to define the status of use of the muscular systems under consideration.

In the following, the basic features of the system that is subject matter of the International Patent No. WO 01/56650 applied to the embodiment of the vibrating footboard according to the invention shown in FIGS. 1-5 are briefly recalled.

The motor 21 is driven by a processing and controlling electronic device, preferably housed in the control panel of the footboard (and possibly coinciding with the processing device of the previously described detection system), that regulates its vibration frequency. In particular, such electronic device is capable to be connected to one or more muscular electrical activity sensors (preferably electromyography sensors) applicable to the user's muscles, capable to output a digital signal that is read by the electronic device. The electronic device processes data coming from said one or more sensors so as to determine, within a range included between a lower limit frequency, preferably equal to 1 Hz, and an upper limit frequency, preferably equal to 1000 Hz, the optimal frequency of vibration of the motor 21 at which the muscle the electrical activity of which is detected has the maximum response to the stimulation and, consequently, setting the frequency of vibration of the same motor. In particular, the lower limit frequency and the upper limit frequency could be variable, depending on the specific fibers of the particular muscle to stimulate, and settable through the footboard control panel.

Once said one or more sensors have been applied, in a conventional way, to corresponding user's muscles, the method for determining the optimal frequency preferably comprises the following steps:

repeating for a number N of times, with N preferably equal to eight, a step of data acquisition wherein the electronic device:

activates the vibration at constant frequency of the motor 21 for a time Δt, with Δt preferably equal to 5 or 10 seconds, with vibration frequency progressively increasing from a repetition to the subsequent one and included between the lower limit frequency and the upper limit frequency, computes, for each repetition, the average of the amplitude of the signal coming from each one of said one or more sensors and it individually stores it and/or it stores at least one function (e.g. a possibly weighted sum or average) of the averages coming from all the sensors, along with the value of the corresponding vibration frequency;

determining the maximum electric response, wherein the electronic device determines, among the stored ones, the average (or said at least one function of the averages) having maximum value, consequently determining the optimal frequency of vibration, at which the muscles the electrical activity of which has been detected have the maximum response.

Preferably, the frequencies of consecutive repetitions, during data acquisition, have a constant difference from one another, more preferably equal (for eight repetitions) to 20 Hz, 25 Hz, 30 Hz, 35 Hz, 40 Hz, 45 Hz, 50 Hz, and 55 Hz, respectively. However, it is also possible to have a variable and increasing difference according to a function of the absolute value of the frequency of the preceding repetition.

Once that the optimal frequency has been determined, it is possible to start the step of muscle stimulation, wherein the electronic device activates the vibration of the motor 21 at such optimal frequency for a time span that is predetermined or selectable by the user (or by a supervising operator) through the footboard control panel.

Possibly, the step of determining the optimal frequency may be periodically repeated, most of all in the case where the time span of the physical exercise is long.

Alternatively, the method for determining the optimal frequency could determine such frequency by successive approximations, through execution of the following steps:

iterating for a number M of times, with M preferably equal to two, cycles of a number $N_i$ of repetitions, where i determines the i-th iteration, of steps of data acquisition wherein the electronic device activates the vibration at constant frequency of the motor 21 for a time Δt, with Δt preferably equal to 10 seconds, with vibration frequency progressively increasing from a repetition to the subsequent one and included between a first lower frequency and a second upper frequency, the frequencies of consecutive repetitions having a constant difference $\Delta f_i$ from one another, where preferably, for the first iteration, the first lower frequency coincides with the lower limit frequency and/or the second upper frequency coincides with the upper limit frequency, the electronic device processing, for each repetition, the average of the amplitude of the signal coming from said one or more sensors and storing it along with the value of the corresponding vibration frequency, the electronic device determining for each iteration i the average having maximum value and determining the corresponding best frequency, in each iteration i, subsequent to the first one, the range between the first lower frequency and the second upper frequency comprising the best frequency as determined in the preceding iteration, preferably as intermediate frequency, in each iteration i, subsequent to the first one, the constant difference $\Delta f_i$ between the frequencies of consecutive repetitions being lower than the difference $\Delta f_{i-1}$ of the preceding iteration ($\Delta f_i < \Delta f_{i-1}$);

determining the optimal frequency, at the end of the M-th iteration, wherein the best frequency determined at the M-th iteration is stored as the optimal frequency, at which the muscles the electrical activity of which has been detected have the maximum response.

In other words, the just described method determines the optimal frequency aiming at determining with progressively better resolution the vibration frequency at which the muscles the electrical activity of which has been detected have the maximum response.

Possibly, the values of the optimal frequencies corresponding to various muscles of the same user could be also stored in portable memory media, such as magnetic and/or optical cards or discs, through an interface of the vibrating footboard control panel, for being readable afterwards by the same interface, avoiding further executions of the method for determining the optimal frequency.

Other embodiments of the vibrating footboard according to the invention can be further provided (alternatively to or in combination with the aforementioned pattern on each one of the two upper plates 12 and 13—or on the different number of upper plates for embodiments different from the one shown in FIGS. 1-5—representing the outline of the respective foot for indicating the correct position of the feet to the user) of a system for detecting the position of the user's feet. Preferably, such system comprises a plurality of sensors, more preferably placed, for each one of the two user's feet, in correspondence with three areas of said one or more upper plates capable to receive a heel, a first metatarsus and a fifth metatarsus of the respective user's foot. Such sensors are preferably connected to a processing device, preferably housed in the footboard control panel (possibly coinciding with the one of the previously described detection system and/or with the processing and controlling electronic device of the previously described system for determining the optimal frequency of vibration and for automatically setting the operation of the—at least one—vibrating motor) to which they send the detected data.

In particular, the processing device may also evaluate and display on the display the position over time of the user's feet, as well as the behaviour of the load exerted by the feet on the two upper plates 12 and 13 (or on the different number of upper plates for embodiments different from the one shown in FIGS. 1-5), for allowing the user (and/or a supervising operator) to monitor the use of the vibrating footboard during exercise, even for diagnostic purposes.

Furthermore, the sensors with which the vibrating footboard is provided may be movable and placeable on the (one or more) upper plates, and the vibrating footboard may be further provided with a podoscope (that is external or even integrated into one or more upper plates) that permits to execute, before the postural examination of the user, a detection of the foot laying of the same user, possibly displayed on the control panel, enabling an operator to correctly and precisely position the sensors for detecting the load, preferably under the first metatarsus, the fifth metatarsus and the heel. Alternatively to or in combination with the movable sensors, said one or more upper plates may be provided with a network of sensors, preferably arranged in an array, connected to and controlled by a processing device (possibly coinciding with the one of the previously described detection system and/or with the processing and controlling electronic device of the system for determining the optimal frequency of vibration and for automatically setting the operation of the—at least one—vibrating motor and/or with the processing device of the system for detecting the position of the user's feet as previously described).

This is extremely advantageous, since it permits a correct neurostimulation of the user (most of all in the case where the latter is a traumatised subject) in standing position for improving, e.g., the muscle tone. In fact, vibration permits to simulate on the vibrating footboard according to the invention a test of movement, i.e. it permits to simulate in few (e.g. 20 or 30) seconds of vibration several minutes of the dynamic activity of the user amplifying and highlighting all the proprioceptive aspects which determines a possible deficit, just thanks to the possibility of positioning the detection sensors exactly on the actual points of the foot (e.g. according the so-called Kapandji physiological parameters).

Other embodiments of the vibrating footboard according to the invention may be further provided, in a conventional way, with a heart rate monitor.

The preferred embodiments of this invention have been described and a number of variations have been suggested hereinbefore, but it should expressly be understood that those skilled in the art can make other variations and changes, without so departing from the scope of protection thereof, as defined by the enclosed claims.

The invention claimed is:

1. A vibrating footboard comprising a base plate and an intermediate plate, the base plate being coupled to the intermediate plate through at least one first vibration-damping element for opposing a movement of the intermediate plate with respect to the base plate, at least one eccentric mass electric motor coupled to the intermediate plate, wherein the vibrating footboard further comprises an even number of upper plates for supporting feet of a user, wherein said even number ranges from two to six, said even number of upper plates being directly coupled to the intermediate plate through at least one second vibration-damping element for each of said upper plates for opposing movement of said upper plates with respect to the intermediate plate, said upper plates being subdivided into two groups specularly equal to each other with respect to a longitudinal axis of the vibrating footboard, said at least one eccentric mass electric motor being coupled to a lower surface of the intermediate plate.

2. A vibrating footboard according to claim 1, wherein the number of said upper plates is equal to six upper plates subdivided into two groups of three upper plates specularly equal to each other with respect to the longitudinal axis of the footboard wherein the first three upper plates of each group correspond to a heel, a first metatarsus and a fifth metatarsus of a respective user's foot.

3. A vibrating footboard according to claim 1, wherein said upper plates are provided with a pattern comprising an outline of the user's feet.

4. A vibrating footboard according to claim 1, wherein said said at least one first vibration-damping elements comprises four first vibration-damping elements.

5. A vibrating footboard according to claim 1, wherein said at least one second vibration-damping elements for each one of said upper plates comprise three second vibration-damping elements for each one of said upper plates.

6. A vibrating footboard according to claim 5, wherein the number of said upper plates is equal to two and said three second vibration-damping elements are placed in correspondence with three areas of each one of the two upper plates for receiving a heel, a first metatarsus and fifth metatarsus of a respective user's foot.

7. A vibrating footboard according to claim 1, wherein said at least one eccentric mass electric motor generates an undulating movement, having a frequency ranging from 1 to 1000 Hz and an amplitude ranging from 1 to 10 mm.

8. A vibrating footboard according to claim 1, wherein said at least one eccentric mass electric motor is coupled in correspondence with a barycentre of the intermediate plate.

9. A vibrating footboard according to claim 1, wherein said at least one eccentric mass electric motor has a longitudinal axis transversely oriented with respect to a longitudinal axis of the vibrating footboard.

10. A vibrating footboard according to claim 1, wherein said at least one eccentric mass electric motor generates both a clockwise and an anticlockwise undulating movement with respect to the longitudinal axis of said at least one motor.

11. A vibrating footboard according to claim 1, wherein said at least one eccentric mass electric motor generates vibrations having different amplitude for each one of two or more corresponding areas of said upper plates, the number of said upper plates being equal to two and said at least one eccentric mass electric motor generates vibrations having different amplitude for each one of said two upper plates.

12. A vibrating footboard according to claim 11, wherein said at least one eccentric mass electric motor comprises at least one electric motor having eccentric masses which are unbalanced with respect to a transverse axis of said at least one electric motor.

13. A vibrating footboard according to claim 1, further comprising at least one vibration sensor for detecting vibrations transmitted to the user, said at least one vibration sensor being connected to a processing device to which it sends detected data related to at least one or more movement parameters comprising vibration amplitude, frequency, acceleration, or velocity.

14. A vibrating footboard according to claim 1, further comprising a system for determining an optimal frequency of a vibration generated by said at least one eccentric mass electric motor and for automatically setting parameters of operation of said at least one eccentric mass electric motor, comprising a processing and controlling electronic device, for setting said parameters of operation of said at least one eccentric mass electric motor, said processing and controlling electronic device for connecting to one or more muscular electrical activity sensors, applicable to one or more muscles of the user, sending detection data to said processing and controlling electronic device, said processing and controlling electronic device processing the detection data received from said at least one muscular electrical activity sensors to determine, within a range included between a lower limit frequency and an upper limit frequency, an optimal frequency of the vibration generated by said at least one eccentric mass electric motor at which the electrical activity of said one or more muscles of the user is maximum, said processing and controlling electronic device setting an optimal frequency of the vibration generated by said at least one eccentric mass electric motor so that it is equal to such optimal frequency.

* * * * *